United States Patent [19]

Lorea

[11] 4,264,784

[45] Apr. 28, 1981

[54] STEREOPHONIC CODER EMPLOYING A MULTILEVEL SWITCHING SYSTEM FOR THE GENERATION OF THE STEREOPHONIC SIGNAL

[76] Inventor: Gianfranco Lorea, Corso Giambone 7, Turin, Italy

[21] Appl. No.: 5,980

[22] Filed: Jan. 24, 1979

[30] Foreign Application Priority Data

May 5, 1978 [IT] Italy ..... 68031 A/78

[51] Int. Cl.[3] ..... H04H 5/00

[52] U.S. Cl. ..... 179/1 GE; 332/40

[58] Field of Search ..... 179/1 GE, 1 GD; 329/50, 329/167; 332/37 R, 40

[56] References Cited

U.S. PATENT DOCUMENTS

| | | | |
|---|---|---|---|
| 3,711,652 | 1/1973 | Metro | 179/1 GE |
| 3,789,323 | 1/1974 | Andersen et al. | 179/1 GE |

FOREIGN PATENT DOCUMENTS

| | | | |
|---|---|---|---|
| 875094 | 8/1961 | United Kingdom | 179/1 GE |

OTHER PUBLICATIONS

"FM Stereo: Time-Division Approach" by Eilers in *Audio,* Aug. 1961; pp. 20–22 and 96.

*Primary Examiner*—Douglas W. Olms

[57] ABSTRACT

In order to obtain a stereophonic coder, the levels of the signals $S_1$, $S_2$ relative to the two channels of a stereophonic system are modified and combined so as to generate a waveform in which the harmonics up to the 6th included have been suppressed; this is achieved by switching actions which occur at intervals of $\frac{1}{8}$ f (f being the frequency of the subcarrier) and are such that a signal is obtained which in the successive intervals is proportional to:

$$(1)\ S_1(8 - \pi - \pi\sqrt{2}) + S_2(8 + \pi + \pi\sqrt{2})$$

$$(2)\ S_1(8 - \pi) + S_2(8 + \pi)$$

$$(3)\ S_1(8 + \pi) + S_2(8 - \pi)$$

$$(4)\ S_1(8 + \pi + \pi\sqrt{2}) + S_2(8 - \pi - \pi\sqrt{2})$$

then to the above values repeated in reverse order, then again to the values repeated in the direct order, and so on. The invention concerns also the coder performing such a process.

6 Claims, 7 Drawing Figures

+18 V
6,8KΩ
T1
2N3904
0,56 KΩ
9,5 KΩ
10µF
C4
8450 pF
10 KΩ
R14
C3
8450 pF
33KΩ
R11
56 KΩ
R12
56 KΩ
R13
39 KΩ
+12 V
+ 12 V
40163
CP
Q0 Q1 Q2 Q3
1-7-9-10-16
3-4-5-6-8
4028 - II
4028 - I
4027-III
4027-II
4027-I
OSC
304 kHz
M 4069 N
F2
F1
D2
D1
E2
E1
C2
100µF
C1
100µF
10µF
SD5000B
II
I
2-7-10-15
2-7-10
R10
R9
R8
R7
R6
R5
R4
R3
R2
R1
4,8 KΩ
6,8 KΩ
6,8 KΩ
5,6 KΩ
73,5 KΩ
73,5 KΩ
4,8 KΩ
6,8 KΩ
6,8 KΩ
5,6 KΩ
2,7 KΩ
R15
5,6KΩ
220µF
1,2KΩ
1,8 KΩ
4,7 KΩ
µA 715
470 pF
100 pF
2,2KΩ
1 KΩ
1,59 mH
L1
C5
796 pF
C6
1270 pF
0,955 mH
L2
C7
477 pF
C8
424 pF
2000 pF
1000 pF
C9
260 pF
R16
3,9 KΩ
1 KΩ
1 KΩ
T2
2N3904
2,7 KΩ
47Ω
1,5 KΩ
33Ω
N
V

STEREOPHONIC CODER EMPLOYING A MULTILEVEL SWITCHING SYSTEM FOR THE GENERATION OF THE STEREOPHONIC SIGNAL (1) The present invention relates to a process and an apparatus for obtaining, from the two channels, respectively A (left) channel and B (right) channel, of a conventional stereophonic broadcast, the multiplex signal for modulating the frequency modulation transmitter according to the system recommended by the CCIR and named "Pilot tone system".

The known devices carrying out such operation, called "stereophonic coders" are based upon several operational principles. In particular, the best results have been achieved by the so called "time division multiplex" principle.

BRIEF DESCRIPTION OF THE DRAWINGS

FIG. 1 of the annexed drawings shows, in the essential lines, the basic diagram of a said coder. In the Figure, I1 and I2 are the inputs to the two channels (A channel and B channel); A1 and A2 are amplitude equalizers whose function is to give the signal the required "pre-emphasis" (that is an amplitude equalization boosting the high frequencies) recommended by the CCIR; C1 and C2 are two linear amplifiers. A 38 kHz oscillator L drives the electronic switching circuit formed by two switches D1, D2 so that they are alternately open or closed for 1/76000 sec.

FIG. 2 shows the signal obtained at the output of the switching circuit when the effect of resistors R1 and R2 is neglected and a sinusoidal signal is applied only to input I1.

Figure 3:
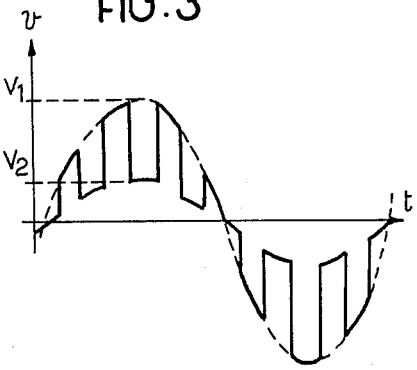
Figure 4:
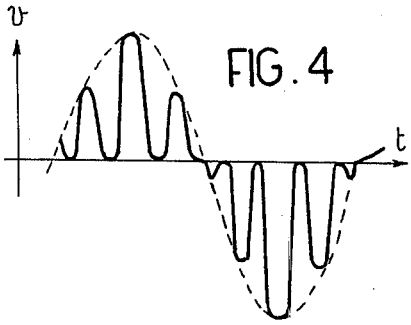

The presence of resistors R1, R2, R3 modifies this signal in the way shown in FIG. 3; the values of the resistors are chosen so that $V1/V2=(4+\pi)/(4-\pi)$, so as to obtain at the output of the low pass filter F, the signal shown in FIG. 4, characterized by the fact that the signals peaks are aligned on the time axis when a sinusoidal signal is applied only on the input I1, phase equalized and with a cutoff frequency of 53 kHz. This signal is added to a sinusoidal pilot signal at 19 kHz obtained from said oscillator L at 38 kHz which is followed by a frequency divider by 2, shown at G, by a filter R eliminating the harmonics and by a phase shifter H.

The output signal of adder S, amplified by M, modulates the FM transmitter.

This kind of apparatus involves considerable difficulties for the adjustment of filter F: in fact, in order to obtain a good transmission quality, the amplitude response of the filter, up to 53 kHz, must be flat to within some tenths of dB, and the associated phase curve must be linear within some degrees. At the same time the filter must sufficiently attenuate the harmonic frequencies above 99 kHz, which are generated, in the modulation process, by the electronic switching circuit formed by D1 and D2. In fact these devices generate a 38 kHz square wave signal which is the stereo multiplex signal.

This signal is formed by a 38 kHz square wave, suppressed carrier amplitude modulated by the signal of the program $(S_1-S_2)$ said modulated wave being added to the signal of the program $(S_1+S_2)$.

$S_1$ and $S_2$ are respectively the signals relating to the left and to the right channels of a stereophonic system after the pre-emphasis operation.

If we consider the spectrum of this signal in the frequency domain it is formed by the spectrum of the signal of the program $(S_1+S_2)$ and by couples of side bands (which refer to the signal of the program $(S_1-S_2)$) distributed at the side of the 38 kHz frequency and at the side of each frequency corresponding to the uneven harmonics.

The couples of side bands pertaining to the harmonics are a disturbing signal and have to be suppressed. Therefore, the lowest frequency value to be eliminated is that corresponding to the third harmonic of the signal at 38 kHz, from which harmonic the maximum value of the modulating frequency (15 kHz), is to be subtracted $(3\times38-15=99$ kHz).

Figure 5:
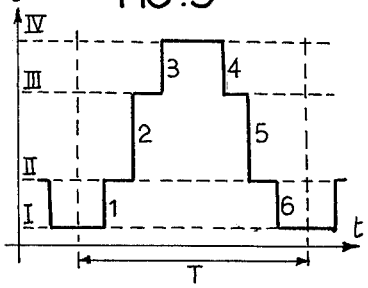
FIGS. 2 through 6 show signal waveforms present in the stereophonic coder.
Figure 2:
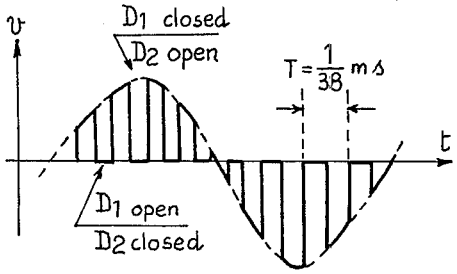

(2) On the other hand it is known that the waveform, of which a period is shown in FIG. 5, contains neither the the even harmonics, nor the third and fifth harmonics, provided that the form is exactly as shown in the figure: that is, the transitions denoted in FIG. 5 by reference 1, 2, 3, 4, 5 and 6 occur at instant T/8, T/4, 3T/8, 5T/8, 3T/4 and 7T/8, and that the signal levels shown at 1, 2, 3, and 4, are respectively proportional to K, $K+\sqrt{2}$, $K+2+\sqrt{2}$, $K+2+2\sqrt{2}$, K being a constant.

Figure 1:
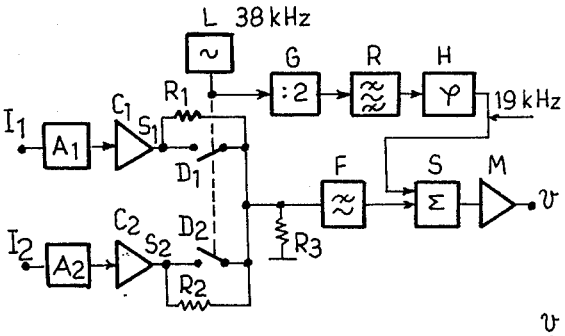
FIG. 1 shows a stereophonic coder.

(3) It is an object of the present invention to provide a process of multilevel switching which allows to apply the properties of the waveform described in the paragraph (2), in order to make a stereophonic coder in which the filters for the stereophonic and pilot signals (corresponding to filters R and F in FIG. 1) are considerably simplified. The process is employed downstream of two amplifying chains of known type in the two stereophonic lines (A channel and B channel) which supply the two electric signals S1 and S2 (FIG. 1).

The process according to the invention of making a stereophonic coder consists in employing the already pre-emphasized signals $S_1$ and $S_2$, relative to the left and right channels of a stereophonic system, modifying and combining their levels in successive time intervals so as to generate a waveform which does not contain the harmonics up to the sixth one included. This result is obtained by switching actions which occur at time intervals equal to $\frac{1}{8}f$, f being the frequency of the subcarrier (according to the present regulations f=38 kHz). The switching action combines the signals $S_1$ and $S_2$ in such a way that in the successive time intervals a signal $S_u$ is generated proportional to the following values:

$$
\begin{aligned}
&(1)\ S_1(8-\pi-\pi\sqrt{2}) + S_2(8+\pi+\pi\sqrt{2}) \\
&(2)\ S_1(8-\pi) + S_2(8+\pi) \\
&(3)\ S_1(8+\pi) + S_2(8-\pi) \\
&(4)\ S_1(8+\pi+\pi\sqrt{2}) + S_2(8-\pi-\pi\sqrt{2})
\end{aligned}
\tag{1}
$$

which are then repeated in reverse order, again in the same order and so on.

In the preferred embodiment of the invention said switching actions occur at time intervals of 1/304,000 seconds. This solution has the advantage of allowing that the minimum frequency past which the subsequent filter must attenuate is shifted to 251 kHz $(7\times 38-15=251)$ as the obtained waveform does not contain the harmonics up to the sixth one included.

The pilot signal can be generated by employing switching actions following each other at time intervals of $\frac{1}{4}f$, so as to provide sequentially levels proportional to the following values:

(1) $1+\sqrt{2}$ (2)

(2) 1

(3) $-1$ (4) $-1-\sqrt{2}$ these values being then repeated in reverse order, in the same order, in the reversed order, and so on. These values have been obtained from the levels of paragraph (2) in which K has been chosen so as to eliminate the DC component. The use of the multilevel pilot signal may be convenient for practical reasons.

(4) The invention includes also the apparatus for realizing the process, characterized in that it comprises more than two switches, synchronously operated and associated to voltage or current dividers, so as to form a stereophonic coder.

Figure 6:
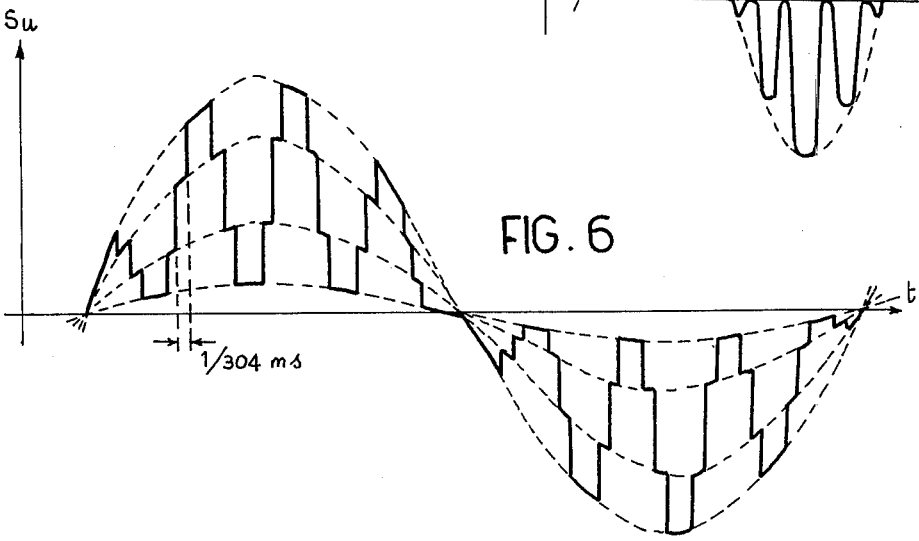

FIG. 6 shows the waveforms downstream the electronic switching circuit, with the same assumption, made above for the waveform of FIG. 3, i.e. that a sinusoidal signal is applied only to the input of channel A.

Figure 7:
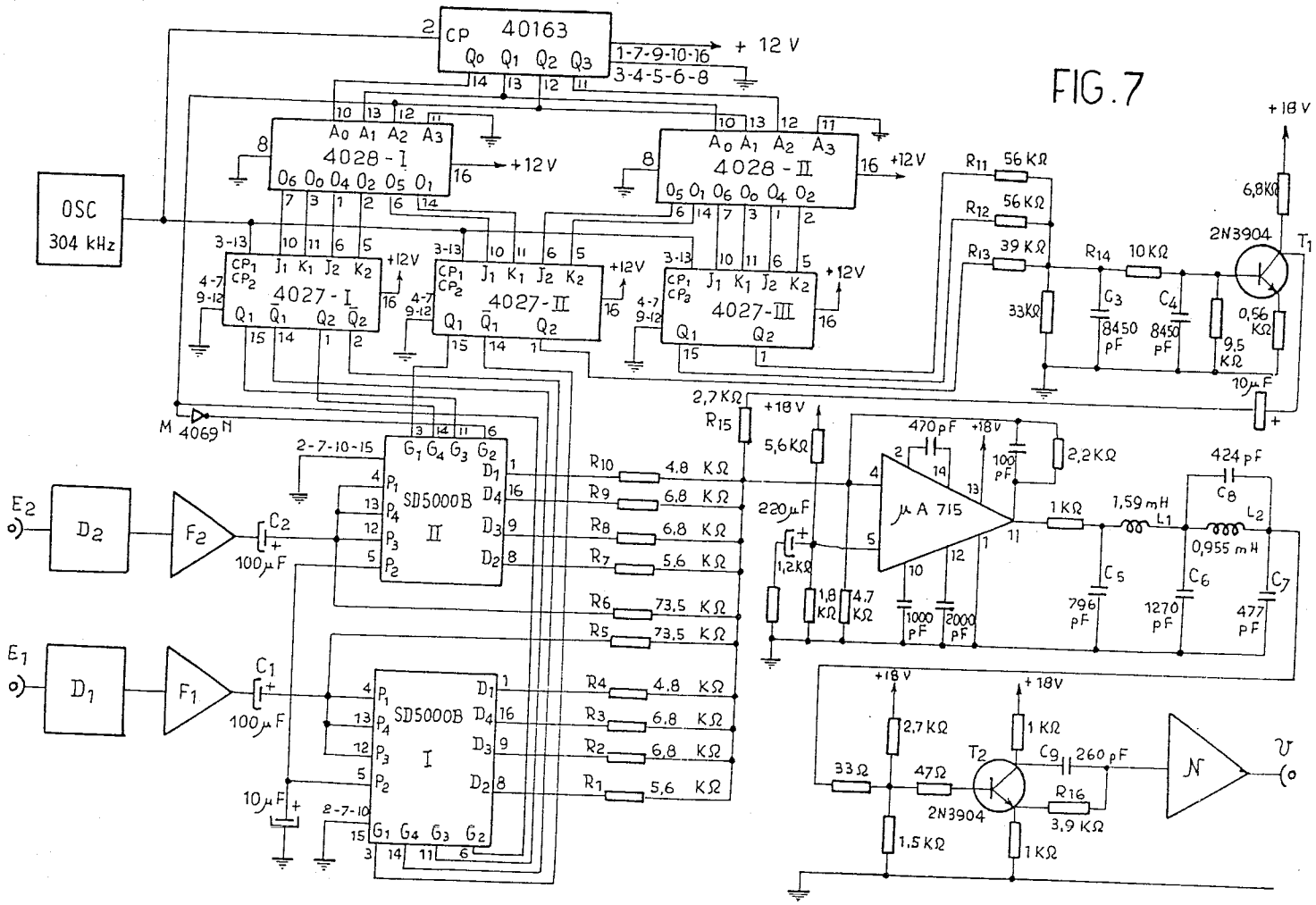
FIG. 7 shows preferred embodiment of the stereophonic coder.

FIG. 7 shows a preferred embodiment of the stereophonic coder utilizing the process according to the invention.

In the drawing, OSC is an oscillator generating a square wave at 304 kHz; microcircuit 40163 is a digital logic circuit formed by four cascade connected bistable circuits (flip-flops), having outputs $Q_0$, $Q_1$, $Q_2$, $Q_3$. The flip-flops are interconnected so as to form a binary synchronous counter which is advanced by one step whenever the signal at 304 kHz applied to input CP passes from its LOW state to its HIGH state. Microcircuits 4028 are decoders which convert the bindary code 1-2-4-8 coming from $Q_0$, $Q_1$, $Q_2$, $Q_3$ into the HIGH state of one among inputs $O_1$, $O_2$, $O_4$, $O_5$, $O_6$, according to the decimal code corresponding to the input binary code. Microcircuits 4027 are each formed by two J-K flip-flops and according to this embodiment the input J of one flip-flop receives a HIGH level at the same time as the input K of the same circuit receives a LOW level or vice-versa. In these two conditions the outputs Q and $\overline{Q}$ reproduce the states of the inputs at the instant at which input CP passes from the LOW level to the HIGH level. In a third condition both inputs J and K receive a LOW level: in this case after the above state transition, outputs Q and $\overline{Q}$ remain in their previous states.

Microcircuits SD5000B are quadruple electronic switches of which P and D are the poles and G is the control input: if the state of said input is HIGH the switch is closed, if the state is LOW the switch is open.

The signals of the two stereophonic channels A and B are applied to two inputs E1 and E2 respectively and they pass through known circuits D1 and D2 comprising the pre-emphasis circuits. Circuits D1, D2 are followed by amplifiers F1, F2 with low output impedance, of known type, which feed signals S1, S2 to the electronic switches through capacitors C1 and C2. Each transition from LOW to HIGH level of the signal coming from the oscillator at 304 kHz advances counter 40163 by one step, so that its outputs $Q_0$, $Q_1$, $Q_2$, $Q_3$ are cyclically in the following states, in successive time intervals:

(1) L, L, L, L
(2) H, L, L, L
(3) L, H, L, L
(4) H, H, L, L
(5) L, L, H, L
(6) H, L, H, L
(7) L, H, H, L
(8) H, H, H, L
(9) L, L, L, H
(10) H, L, L, H
(11) L, H, L, H
(12) H, H, L, H
(13) L, L, H, H
(14) H, L, H, H
(15) L, H, H, H
(16) H, H, H, H where L denotes the LOW state and H the HIGH state. These signals are applied to the inputs of both microcircuits 4028. In correspondence to the above time intervals the following outputs of circuit 4028-I are at state H:

(1) $O_0$
(2) $O_1$
(3) $O_2$
(4) none
(5) $O_4$
(6) $O_5$
(7) $O_6$
(8) none
(9) $O_0$
(10) $O_1$
(11) $O_2$
(12) none
(13) $O_4$
(14) $O_5$
(15) $O_6$
( 16) none The outputs not mentioned remain at "L".

It will be appreciated that states 1 to 8 are identical to states 9 to 16, so that it will be sufficient to consider the first eight states.

The outputs of microcircuit 4028-I are connected to J and K inputs of the 1st and 2nd sections of microcircuit 4027-I and of the first section of circuit 4027-II. Correspondingly, in the time intervals hereinabove referred to, at whose ends the signal at 304 kHz, applied to inputs CP, passes from LOW to HIGH, three outputs $\overline{Q}_1-I$; $\overline{Q}_2-I$; $\overline{Q}_1-II$ are respectively in the states:

(1) L, L, L
(2) H, L, L
(3) H, L, H
(4) H, H, H
(5) H, H, H
(6) H, L, H
(7) H, L, L
(8) L, L, L

Said outputs are respectively connected to control inputs G3, G4, G1 of microcircuit SD 5000 B-I in order to close the corresponding switches. Through these switches signal S1 is fed, in the successive time intervals corresponding to those above referred to, to resistors:

(1) R5
(2) R5, R2
(3) R5, R2, R4
(4) R5, R2, R4, R3
(5) R5, R2, R4, R3
(6) R5, R2, R4
(7) R5, R2
(8) R5

At the same time, the signals coming from Q1−I, $Q_2$−I, $Q_2$−III are fed to control inputs G3, G4, G1 of microcircuit SD 5000 B-II.

In the corresponding time periods signal S2 passes through resistors:

(1) R8, R9, R10, R6
(2) R9, R10, R6
(3) R9, R6
(4) R6
(5) R6
(6) R6, R9
(7) R6, R9, R10
(8) R6, R9, R10, R8

As all the above mentioned resistors are connected to input 4 of amplifying microcircuit μA 715, arranged so as to have a low input impedance, the currents arriving to said input are proportional both to the voltage applied upstream the resistors and also to the conductance thereof. Therefore, if the resistance values are those shown in the drawing, the overall current flowing towards input 4 of amplifier μA 715 is proportional to the levels given by relations (1).

The operation of the above mentioned switches introduces into the useful signal an impulsive noise of main frequency 304 kHz, provided that these switches are regularly operated every 1/304000 sec. In the sequences of time intervals referred to in connection with the switch control, there is no switching between intervals 4 and 5 and between interval 8 of a sequence and interval 1 of the subsequent sequence.

This would entail a noise component at 76 kHz. This drawback is obviated by sending the signal of Q2 to G2-I and the same signal, inverted by inverter gate 4069 to G2-II, so that the two pulses lacking in each sequence are generated.

The pilot signal is obtained by employing the signals outcoming from gates $Q_2$−II, $Q_1$−III, $Q_2$=III, and by means of resistors R11, R12, R13 the levels disclosed by relations (2) are generated; moreover, the pilot signal is generated with a delay of 22,5 degrees with respect to the exact position with which it has to be inserted. To sufficiently attenuate the 7th and 9th harmonic of the pilot signal there is provided the low pass filter formed by C3, C4, R14 which moreover delays the signal at frequency 19 kHz by 157,5 degrees (157,5+22,5=180). The signal is then amplified by T1 and fed through R15 to the same input 4 of microcircuit μA 715.

Microcircuit μA 715 supplies low pass filter formed by C5, C6, C7, C8, L1 and L2, which has border frequency at 200 kHz and in turn supplies transistor T2, whose network formed by C9 and R16 carries out a slight phase adjustment. The subsequent amplifier N of known type, with high input impedance, supplies output terminal U of the apparatus. The resistors, coils and non electrolytical capacitors must have a tolerance not greater than 1%.

It is itself evident that according to the disclosed principle the number of switchings can be increased so as to obtain a curve similar to that of FIG. 5 but without some harmonics past the 6th one (for instance up to the 10th harmonic); also such as embodiment lies within the scope of this invention.

It is to be noted that the circuits shown in FIG. 7 by their commercial denomination are manufactured respectively by firms:

Fairchild, as to circuits 40163; 4028, 4027; μA 715;
Signetics, as to circuit SD 5000 B.

Equivalents circuits having other denominations are also commercially available.

The same FIG. 7 may undergo changes and modifications which will be apparent to those skilled in the art.

What I claim is:

1. A process for realizing a stereophonic coder, characterized in that it consists in employing signals $S_1$ and $S_2$, already pre-emphasized, relative to the left and respectively the right channel of a stereophonic system, by modifying and combining their levels in successive time intervals so as to obtain a waveform without the harmonics up to the 6th one included; this result being obtained by switching actions occurring at time intervals equal to $\frac{1}{8}$f, f being the frequency of the subcarrier, in such a way that in the successive intervals a signal $S_u$ is generated proportional to the following values:

$$\begin{aligned}
&(1)\ S_1(8-\pi-\pi\sqrt{2}) + S_2(8+\pi+\pi\sqrt{2}) \\
&(2)\ S_1(8-\pi) + S_2(8+\pi) \\
&(3)\ S_1(8+\pi) + S_2(8-\pi) \\
&(4)\ S_1(8+\pi+\pi\sqrt{2}) + S_2(8-\pi-\pi\sqrt{2})
\end{aligned} \tag{1}$$

which are then repeated in reverse order, then again in the same order and so on.

2. A process according to claim 1, characterized in that said frequency f is 38 kHz.

3. A process according to claims 1 or 2, characterized in that the pilot signal of the stereophonic coder is obtained by employing switching actions which follow one another at time intervals of 1/152000 sec so as to give sequential levels proportional to the following values:

$$\begin{aligned}
&(1)\ 1+\sqrt{2} \\
&(2)\ 1 \\
&(3)\ -1 \\
&(4)\ -1-\sqrt{2}
\end{aligned} \tag{2}$$

these values being then repeated in reverse order, in direct order, in reverse order and so on.

4. A stereophonic coder characterized in that it comprises more than two switches synchronously driven and associated to voltage or current dividers so as to obtain the suppression of the harmonics up to the 6th one by applying the process according to claim 3.

5. A stereophonic coder according to claim 4, characterized in that it comprises switching and dividing means arranged to generate the pilot signal through a multilevel switching, eliminating the harmonics of said signal up to the 6th one included.

6. A stereophonic coder according to claim 5, characterized in that the switching actions which serve to generate the pilot signal follow one another at a rate of 1/152000 sec.

* * * * *